US008780021B2

(12) United States Patent
Han

(10) Patent No.: US 8,780,021 B2
(45) Date of Patent: Jul. 15, 2014

(54) PIXEL, DISPLAY DEVICE AND DRIVING METHOD THEREOF

(75) Inventor: Sang-Myeon Han, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 188 days.

(21) Appl. No.: 13/408,372

(22) Filed: Feb. 29, 2012

(65) Prior Publication Data

US 2013/0127932 A1 May 23, 2013

(30) Foreign Application Priority Data

Nov. 18, 2011 (KR) ..... 10-2011-0120918

(51) Int. Cl.
*G09G 3/30* (2006.01)

(52) U.S. Cl.
USPC ..... 345/78; 345/212; 345/690; 345/77; 345/92; 315/291; 315/169.1; 315/360

(58) Field of Classification Search
CPC . G09G 3/3233; G09G 3/3208; G09G 3/3241; G09G 3/3283; H05B 37/02
USPC ..... 345/76–78, 92, 204, 211, 212, 690, 345/691; 315/169.1–169.3, 291, 360
See application file for complete search history.

(56) References Cited

U.S. PATENT DOCUMENTS

| | | | | |
|---|---|---|---|---|
| 7,528,812 | B2 * | 5/2009 | Tsuge et al. | 345/78 |
| 7,932,880 | B2 * | 4/2011 | Takahara et al. | 345/76 |
| 8,436,791 | B2 * | 5/2013 | Ota et al. | 345/78 |
| 2008/0036706 | A1 * | 2/2008 | Kitazawa | 345/76 |
| 2011/0298836 | A1 * | 12/2011 | Komiya et al. | 345/690 |
| 2012/0249615 | A1 * | 10/2012 | Lee | 345/691 |
| 2013/0335396 | A1 * | 12/2013 | Kim | 345/212 |

FOREIGN PATENT DOCUMENTS

| | | | |
|---|---|---|---|
| KR | 10-2008-0000468 | A | 1/2008 |
| KR | 10-2009-0131041 | A | 12/2009 |
| KR | 10-2011-0013693 | A | 2/2011 |
| KR | 10-2011-0045228 | A | 5/2011 |

* cited by examiner

*Primary Examiner* — Haiss Philogene
(74) *Attorney, Agent, or Firm* — Lee & Morse, P.C.

(57) ABSTRACT

A pixel, a display device using the pixel and a method of driving the display device are provided. The pixel may include an organic light emitting diode, a driving circuit for generating and transmitting driving current depending on data signals to the organic light emitting diode, and at least one switch connected between a power wire for applying a first voltage to the organic light emitting diode and a data line for transmitting the data signals. The at least one switch may include a compensating circuit for electronically connecting the power wire to the data line for a predetermined period to transmit the first voltage through the data line.

13 Claims, 11 Drawing Sheets

FIG.9

10

| | | | | | |
|---|---|---|---|---|---|
| A | A | A | A | A | A |
| A | A | A | A | A | A |
| A | A | A | A | A | A |
| A | A | A | A | A | A |
| A | A | A | A | A | A |
| A | A | A | A | A | A |

FIG.10

10

| | | | | | |
|---|---|---|---|---|---|
| A | A | A | A | A | A |
| B | B | B | B | B | B |
| A | A | A | A | A | A |
| B | B | B | B | B | B |
| A | A | A | A | A | A |
| B | B | B | B | B | B |

FIG.11

10

| | | | | | |
|---|---|---|---|---|---|
| A | A | A | A | A | A |
| B | B | B | B | B | B |
| B | B | B | B | B | B |
| A | A | A | A | A | A |
| B | B | B | B | B | B |
| B | B | B | B | B | B |

FIG.12

10

| | | | | | |
|---|---|---|---|---|---|
| A | A | A | A | A | A |
| B | B | B | B | B | B |
| B | B | B | B | B | B |
| B | B | B | B | B | B |
| A | A | A | A | A | A |
| B | B | B | B | B | B |

FIG.13

10

| | | | | | |
|---|---|---|---|---|---|
| A | B | A | B | A | B |
| B | A | B | A | B | A |
| A | B | A | B | A | B |
| B | A | B | A | B | A |
| A | B | A | B | A | B |
| B | A | B | A | B | A |

FIG.14

10

| | | | | | |
|---|---|---|---|---|---|
| A | B | B | A | B | B |
| B | A | B | B | A | B |
| B | B | A | B | B | A |
| A | B | B | A | B | B |
| B | A | B | B | A | B |
| B | B | A | B | B | A |

PIXEL, DISPLAY DEVICE AND DRIVING METHOD THEREOF

CROSS-REFERENCE TO RELATED APPLICATION

This application claims priority to and the benefit of Korean Patent Application No. 10-2011-0120918 filed in the Korean Intellectual Property Office on Nov. 18, 2011, the entire contents of which are incorporated herein by reference.

BACKGROUND

1. Field

Embodiments relate to a pixel, a display device using the pixel, and a method of driving the display device. More particularly, embodiments relate to a pixel for driving a display panel by compensating a power wire of a light emitting diode, a display device including the pixel, and a method of driving the display device.

2. Description of the Related Art

Recently, a variety of flat panel displays have been developed to reduce the weight and volume that are a drawback of cathode ray tubes. Examples of the flat panel displays include a liquid crystal display (LCD), a field emission display (FED), a plasma display panel (PDP), and an organic light emitting diode (OLED) display, etc.

Among the flat panel displays, the OLED displays display images with organic light emitting diodes (OLED) which emit light by means of recombination of electrons and holes, an advantage of which is a quick response speed and low power consumption in driving the displays.

In general, the OLED displays are classified into passive matrix type OLED (PMOLED) and active matrix type OLED (AMOLED), in terms of the method of driving organic light emitting diodes. The aforementioned AMOLED display includes a plurality of scan lines, a plurality of data lines, and a plurality of power wires, and a plurality of pixels connected to the lines and disposed in a matrix type. Each of the pixels usually include an organic light emitting diode, at least two transistors, i.e., a switching transistor for transmitting data signals and a driving transistor for driving the organic light emitting diode depending on data signals, and one capacitor for holding data voltage depending on the data signals.

Research and development for manufacturing display panels has tended to focus on having a wide area and high image quality for a driving circuit structure constructing such a display device. For example, research has been conducted to develop compensating circuits including a plurality of transistors and capacitors in order to solve the problem of non-uniform intensity of driving current and non-uniform image display due to threshold voltage deviation in the driving transistor.

Meanwhile, research has also been conducted for driving circuits appropriate for new driving methods of light emission of display devices. Since resultant driving circuits developed are equipped with a lot of transistors and capacitors and complex in terms of circuit configuration, there is a high possibility of low aperture ratios and defective displays. In terms of power consumption, it may be difficult to ensure and reduce consumed power only with the power wires of the related art connected to the organic light emitting diode.

The above information disclosed in this Background section is only for enhancement of understanding of the background of the invention and therefore it may contain information that does not form the prior art that is already known in this country to a person of ordinary skill in the art.

SUMMARY

An exemplary embodiment includes a pixel having an organic light emitting diode, a driving circuit for generating and transmitting driving current depending on data signals to the organic light emitting diode, and at least one switch connected between a power wire for applying a first voltage to the organic light emitting diode and a data line for transmitting the data signals. The switch may include a compensating circuit for electronically connecting the power wire to the data line for a predetermined period to transmit the first voltage through the data line.

The predetermined period may be a period of light emission when the organic light emitting diode is lighted.

The switch may be controlled to be turned on/off in response to switching control signals.

The organic light emitting diode may include one electrode connected to the driving circuit, and the other electrode connected to a power supply for applying a second voltage, and the voltage difference between the first voltage and the second voltage may be kept above a predetermined voltage for the predetermined period to light the organic light emitting diode.

The switch may electronically connect the power wire to the data line for the other periods than the predetermined period, and transmits the first voltage to reset the operation of the driving circuit.

The first voltage may be a low voltage below a predetermined level.

The switch may be a PMOS transistor or an NMOS transistor, but is not particularly limited thereto.

The driving circuit may include a first transistor including a gate connected to a scan line for transmitting scan signals, a first end connected to the data line, and a second end connected to a first node; a second transistor including a gate connected to a second node, a first end connected to the power wire, and a second end connected to one electrode of the organic light emitting diode; a third transistor including a gate connected to a gate line for transmitting gate signals, a first end connected to the second node, and a second end connected to both the second end of the second transistor and one electrode of the organic light emitting diode; and a first capacitor including a first electrode connected to the first node and a second electrode connected to the second node.

The first to third transistors may be a PMOS transistor or an NMOS transistor.

The driving circuit may further include a second capacitor including one electrode connected to the first node and the other electrode connected to the power wire.

The driving circuit may be activated before the predetermined period to write data voltage depending on the data signals and to compensate for the threshold voltage of a driving transistor for generating driving current depending on the data signals.

The organic light emitting diode may include a first electrode connected to the driving circuit and a second electrode connected to the power supply for applying the second voltage. The first voltage may be applied as a voltage value of at least three different levels for one frame period and the second voltage may be applied as a voltage value of at least two different levels for the one frame period.

The organic light emitting diode may be lighted in the period where the difference between the first voltage and the second voltage is the greatest.

Another exemplary embodiment may provide a display device, including: a display unit including a plurality of pixels connected to a plurality of scan lines, a plurality of gate lines, a plurality of data lines, a plurality of compensating wires, and a plurality of power wires; a scan driver for generating and transmitting scan signals to each of the plurality of pixels through the plurality of scan lines; a gate driver for generating and transmitting gate signals to each of the plurality of pixels through the plurality of gate lines; a data driver for transmitting data voltage to each of the plurality of pixels through the plurality of data lines depending on data signals; a power wire compensation unit for generating and transmitting compensating control signals to each of the plurality of pixels through the plurality of compensating wires and for electrically connecting the power wires to the data lines in response to the compensating control signals; a power source controller for regulating and transmitting a first voltage and a second voltage different from each other, to each of the plurality of pixels through the plurality of power wires; and a timing controller for generating and transmitting control signals for controlling the scan driver, the gate driver, the data driver, the power wire compensation unit, and the power source controller.

The power wire may be electrically connected to the data line for a predetermined period, and the first voltage transmitted through the power wire may be applied to the pixels through the data line.

The predetermined period may be a period of light emission when the plurality of pixels included in the display unit simultaneously emit light.

The power wire may be electrically connected to the data line for the other periods than the predetermined period to reset data voltage applied to the pixels.

The power source controller regulates the first voltage and the second voltage to a voltage value of each different level for one frame period to transmit the regulated voltage value to each of the plurality of pixels.

In this case, the first voltage may be applied as a voltage value of at least three different levels for the one frame period, and the second voltage may be applied as a voltage value of at least two different levels in the one frame period.

The plurality of pixels emits light in the period where the voltage difference between the first voltage and the second voltage is the greatest for the one frame period.

Each of the plurality of pixels may include an organic light emitting diode, a driving circuit for generating and transmitting driving current to the organic light emitting diode depending on data signals, and a compensating circuit including at least one switch for receiving the compensating control signals to connect the power wire to the data line.

As another exemplary embodiment, the display unit may include: a plurality of first pixels consisting of an organic light emitting diode, a driving circuit for generating and transmitting driving current to the organic light emitting diode depending on data signals, and a compensating circuit including at least one switch for receiving the compensating control signals to connect the power wire to the data line; and a plurality of second pixels consisting of an organic light emitting diode and a driving circuit for generating and transmitting driving current to the organic light emitting diode depending on data signals.

The display unit may include a plurality of first pixel rows in which the plurality of first pixels are disposed along a first direction, and a plurality of second pixel rows in which the plurality of second pixels are disposed along the first direction. The plurality of first pixel rows and the plurality of second pixel rows may be alternately disposed along a second direction different from the first direction.

In the display unit, at least two matrixes may be repeatedly connected, in which at least two second pixel rows corresponding to one first pixel row are consecutively disposed in the second direction.

In the display unit, the plurality of first pixels and the plurality of second pixels may be alternately disposed along a first direction and a second direction different from the first direction.

The scan signals and the gate signals may be sequentially transmitted to each of the plurality of pixels for a first period other than the period when the power wire is electrically connected to the data line for one frame period.

The one frame period may include a reset period for resetting data voltage for a previous frame period applied to the plurality of pixels, an on-bias period for applying a predetermined established voltage to a driving transistor in the plurality of pixels, a compensation and scan period for compensating for a threshold voltage of the driving transistor and transmitting scan signals to each of the plurality of pixels to activate the pixels and a light emission period for enabling the plurality of pixels to emit light simultaneously. In this case, the first period may be a compensation and scan period.

Yet another exemplary embodiment of the present invention provides a method of driving a display device, including: a reset step of resetting data voltage in a previous frame stored in each of a plurality of pixels constituting a display unit by simultaneously applying a first voltage and a second voltage having a voltage value of a predetermined level, scan signals, gate signals, and compensating control signals to each of the plurality of pixels; an on-bias step of applying on-bias voltage to a driving transistor included in each of the plurality of pixels by raising the first voltage above the predetermined level to transmit the first voltage; a compensation and scan step of transmitting data voltage depending on data signals corresponding to each of the plurality of pixels while compensating for a threshold voltage of a driving transistor included in each of the plurality of pixels, by sequentially applying scan signals and gate signals through a scan line connected to each of the plurality of pixels and applying a first voltage and a second voltage having a voltage value of a predetermined level and compensating control signals to each of the plurality of pixels; and a light emission step of emitting the entire pixels simultaneously emitting light at a luminance corresponding to the data voltage stored in each of the pixels by simultaneously applying a first voltage and a second voltage having a voltage value of a predetermined level, scan signals, gate signals, and compensating control signals to each of the plurality of pixels.

The aforementioned steps may be implemented for one frame period.

The first voltage may be applied as a voltage value of at least three different levels for one frame period, and the second voltage may be applied as a voltage value of at least two different levels for the one frame period.

The sequences of the reset step and the on-bias step may be shifted to each other.

In the reset step, the first voltage may be applied at a low level, and the second voltage may be applied at a high level, the scan signals and the gate signals may be applied at a low level, and the compensating control signals may be applied at a low level.

In the on-bias step, the first voltage may be applied at an intermediate level between a low level and a high level.

In the compensation and scan step, the first voltage is applied at an intermediate level, the second voltage may be applied at a high level, the scan signals and the gate signals may be applied at a low level or a high level, and the compensating control signals may be applied at a high level.

In the light emission step, the first voltage may be applied at a high level, the second voltage may be applied at a low level, the scan signals may be applied at a low level and the gate signals may be applied at a high level, and the compensating control signals may be applied at a low level.

In the reset step and the light emission step, at least one switch included in each of the plurality of pixels electrically connects the power wire for applying the first voltage to the data line for transmitting the data signals in response to the compensating control signals.

BRIEF DESCRIPTION OF THE DRAWINGS

FIG. 9 to FIG. 14 are diagrams showing a pixel configuration of a display unit in a display device according to various exemplary embodiments.

DETAILED DESCRIPTION

Figure 1:
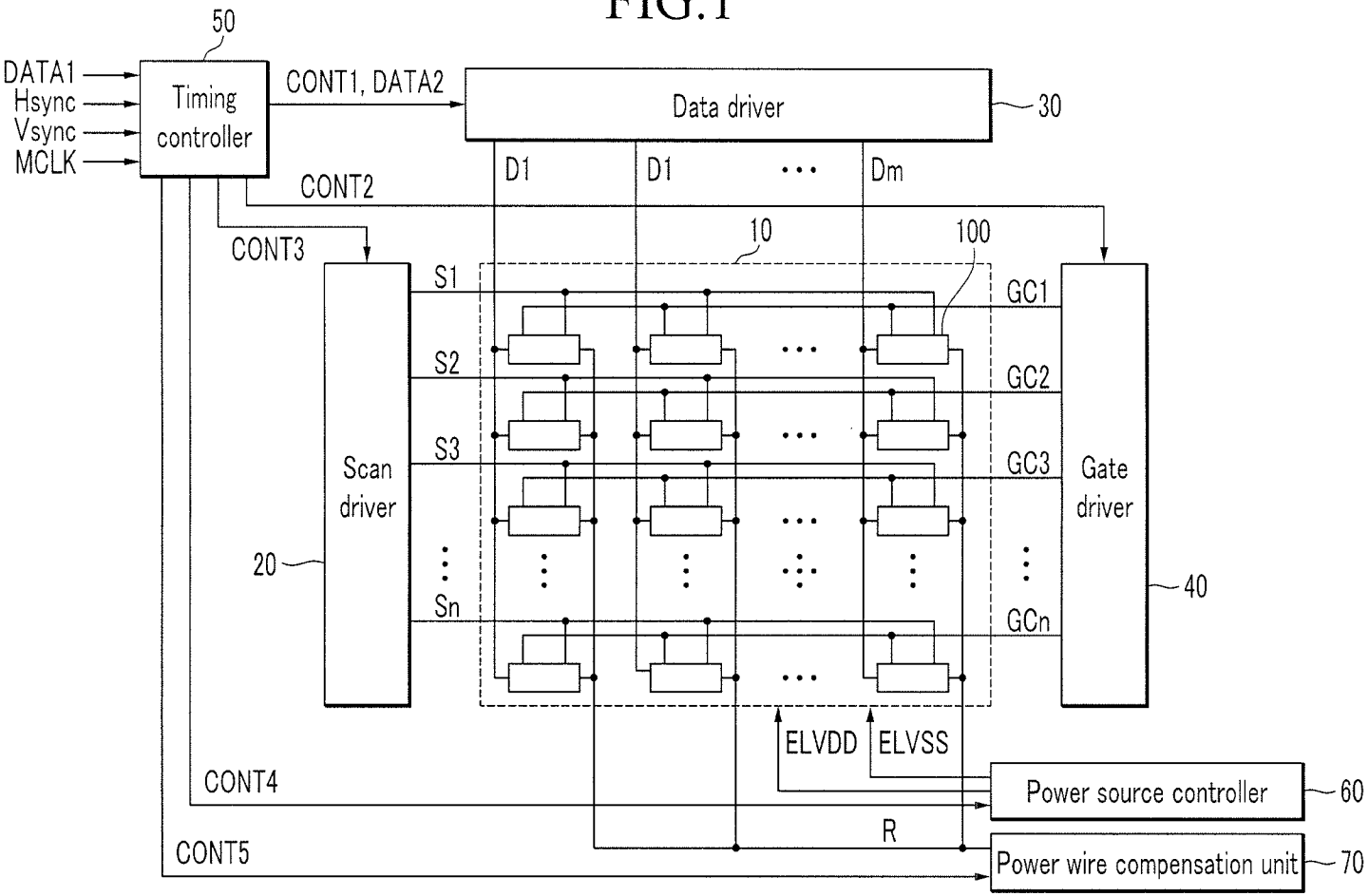
FIG. 1 is a block diagram of a display device according to an exemplary embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete.

Further, in the embodiments, like reference numerals designate like elements throughout the specification representatively in a first exemplary embodiment and only elements other than those of the first exemplary embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram of a display device according to an exemplary embodiment. Referring to FIG. 1, the display device according to the exemplary embodiment includes a display unit 10 including a plurality of pixels 100, a scan driver 20, a data driver 30, a gate driver 40, a timing controller 50, a power source controller 60, and a power wire compensation unit 70.

Each of the plurality of pixels is connected to scan lines S1 to Sn connected to the scan driver 20, gate lines GC1 to GCn connected to the gate driver 40, data lines D1 to Dm connected to the data driver 30, power wires (not shown) connected to the power source controller 60, and compensating wires RL connected to the power wire compensation unit 70.

The scan driver 20 generates and transmits scan signals to each pixel through the scan lines S1 to Sn.

The data driver 30 receives image data signals Data2 corresponding to external video signals Data1 to provide the image data signals to each pixel through the data lines D1 to Dm.

The gate driver 40 generates and transmits gate control signals to each pixel through the gate lines GC1 to GCn.

The power source controller 60 applies a first power source voltage ELVDD and a second power source voltage ELVSS through the power wire connected to each of the plurality of pixels of the display unit 10.

As will be described with reference to FIG. 2, the plurality of pixels included in the display unit can simultaneously perform light emission and extinction within one image frame depending on the driving method of light emission. In particular, all of the pixels in the display unit can be simultaneously lighted with the resulting driving current after data signals are sequentially written to display images (simultaneous light emission scheme). In this case, the power source controller 60 can regulate each of the first power source voltage ELVDD or the second power source voltage ELVSS to a voltage of a high level (e.g., logic "1") or low level (e.g., logic "0") to apply the voltage to each pixel in the display unit 10.

Figure 2:
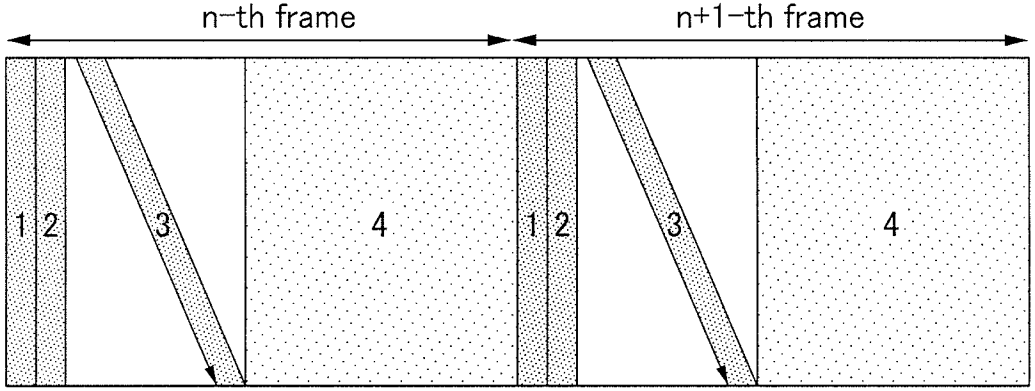
FIG. 2 is a diagram showing a driving method of light emission of a display device according to an exemplary embodiment.

More specifically, referring to the driving timing diagram of FIG. 2, one image frame includes a reset period 1 for resetting data voltage applied to each pixel, an on-bias period 2 for applying a voltage of a predetermined level to the driving transistor in order to reduce or eliminate hysteresis of the driving transistor in the pixel, a compensation and scan period 3 for compensating for the threshold voltage of the driving transistor of the pixel and writing data voltage depending on image data signals, and a light emission period 4 for enabling all of the pixels to be lighted with the driving current depending on the data voltage to display images.

In this case, the power source controller 60 may regulate the first power source voltage ELVDD or the second power source voltage ELVSS in order to achieve a small difference in the voltage levels in the extinction period including the reset period 1, the on-bias period 2, and the compensation and scan period 3, to apply the voltage to each pixel in the display unit.

The power source controller 60 may regulate the first power source voltage ELVDD and the second power source voltage ELVSS in order to achieve a great difference in the voltage levels in the light emission period 4 when pixels are simultaneously lighted depending on the image data voltage depending on the data signals, to transmit the voltage. For example, the power source controller 60 may control the first power source voltage ELVDD to be raised to a high level or the second power source voltage ELVSS to be dropped to a low level to be transmitted.

Since there is a growing tendency for display panels to be manufactured with a wide area, the IR-drop phenomenon due to the power wire connected to the display unit results in a voltage drop when the power source controller 60 supplies consumed power to the organic light emitting diode of each pixel through the power wire (not shown). The display device of the present embodiment further includes a power wire compensation unit 70 in order to compensate for lowered luminance uniformity due to the voltage drop in displaying images by the display unit. The power wire compensation unit 70 is connected to each pixel in the display unit 10 through the plurality of compensating wires RL. The power wire compensation unit 70 transmits compensating control signals to each pixel through the reinforcing wires RL to control conduction of power supplied by the power source controller 60. That is, while the driving circuit will be described in detail below in the pixel having the circuit structure according to one exemplary embodiment of the present invention, the data line connected to each pixel depending on the compensating control signals transmitted from the power wire compensation unit 70 is connected to the power wire for supplying the first power source voltage ELVDD to result in electrical conduction. Therefore, it is possible to improve deteriorated optical characteristic uniformity resulting from non-uniform voltage wire distribution in the display unit 10.

The timing controller 50 generates control signals for controlling the scan driver 20, the data driver 30, the gate driver 40, the power source controller 60, and the power wire compensation unit 70 to transmit the control signals to each component.

Further, the timing controller 50 is externally provided with video signals Data1, vertical synchronization signals Vsync, horizontal synchronization signals Hsync, clock signals MCLK, etc., and transmits image data signals Data2 corresponding to the video signals Data1 to the data driver 30.

Specifically, the timing controller 50 generates scan driving control signals CONT3 for controlling the scan driver 20 to transmit the signals to the scan driver 20. The scan driver 20 may then be controlled to apply scan signals to the display unit 10 every specific cycle (e.g., every horizontal synchronization signal Hsync cycle).

The timing controller 50 generates and transmits data driving control signals CONT1 for controlling the data driver 30 together with the image data signals Data2 to the data driver 30. The data driver 30 may then be controlled to apply image data signals Data2 to the display unit 10 every specific cycle (e.g., every vertical synchronization signal Vsync cycle).

The timing controller 50 generates and transmits gate driving control signals CONT2 for controlling the gate driver 40 to the gate driver 40.

The gate driver 40 may then be controlled to apply gate signals to the display unit 10 every specific cycle (e.g., every horizontal synchronization signal Hsync cycle).

The timing controller 50 generates and transmits power control signals CONT4 for controlling the power source controller 60 to the power source controller 60. Therefore, the power source controller 60 controls the first power source voltage ELVDD and the second power source voltage ELVSS to be applied to each of the plurality of pixels of the display unit 10 through the power wire (not shown) connected thereto. As described above, the first power source voltage ELVDD and the second power source voltage ELVSS may be regulated so that a voltage level to be applied becomes different as the display unit is manufactured with a large area, and the driving method of pixels is diversified into the progressive or simultaneous emission scheme, etc.

More particularly, in the related art, the first power source voltage ELVDD is provided as a voltage of a fixed high level, and the second power source voltage ELVSS is applied as a voltage of a fixed low level, to each pixel in the display unit. However, in the driving method of pixels according to an embodiment, the first power source voltage ELVDD and the second power source voltage ELVSS may be applied in three manners described below.

The first manner is to apply the first power source voltage ELVDD as a voltage value of three different levels and to apply the second power source voltage ELVSS as a fixed low level (e.g., ground). That is, in this case, since the second power source voltage ELVSS is output as a voltage value of a constant level GND from the power source controller 60 at all times, it is not necessary to implement the second power source voltage ELVSS with a separate driving circuit, and a circuit cost may thus be saved. On the contrary, since the first power source voltage ELVDD requires a negative voltage value (e.g. −3V) among three levels, the circuit configuration of the power source controller 60 for applying the first power source voltage ELVDD may be made complex.

The second manner is to implement both the first power source voltage ELVDD and the second power source voltage ELVSS to be applied as a voltage value of two levels, respectively. In this case, the power source controller 60 may include both a driver for driving the first power source voltage and a driver for driving the second power source voltage.

The third manner, which is opposite to the first manner, is to apply the first power source voltage ELVDD as a voltage value of a fixed high level and to apply the second power source voltage ELVSS as a voltage value of three different levels. That is, in this case, since the first power source voltage is output as a voltage value of a constant level at all times, it is not necessary to implement the first power source voltage with a separate driving circuit, and a circuit cost may be thus saved for the configuration of the power source controller 60. On the contrary, since the second power source voltage ELVSS requires a positive voltage value among three levels, the circuit configuration of the driver for driving the second power source voltage ELVSS may be made complex in the power source controller 60.

The circuit configuration of the power source controller 60 may vary depending on the driving method of pixels, but is not particularly limited to the manners described above. The timing controller 50 generates and transmits power control signals CONT4 to control power supply depending on the driving method of pixels in response to the power source controller 60 of which the circuit configuration varies depending on the driving method of pixels.

Further, the timing controller 50 generates and transmits power compensating control signals CONT5 to the power wire compensation unit 70 to control the power wire compensation unit 70 so that the first power source voltage supplied from the power source controller can be applied to the data line.

FIG. 2 is a diagram showing the operation of the driving method of light emission of a display device according to an exemplary embodiment. In particular, the exemplary embodiment of FIG. 2 employs the simultaneous emission scheme, not the progressive emission scheme, for driving the display device.

That is, as shown in FIG. 2, after data signals are sequentially input for one frame period, and the data input is completed, the entire display unit 10, i.e., all of the pixels in the display unit, is lighted by the driving current depending on the data signals in one frame.

Referring to FIG. 2, the driving includes the reset period 1, the on-bias period 2 for applying a predetermined voltage to the driving transistor, the scan period (data input period) 3 for transmitting data signals after compensating for the threshold voltage of the driving transistor and scanning and activating each of the plurality of pixels, and the light emission period 4 for the pixels being simultaneously lighted depending on the data signals. Specifically, the reset period 1 is a period when the data voltage applied to each pixel 100 of the display unit 10 is reset, and, specifically, the voltage transmitted to the driving transistor is dropped below a voltage of a predetermined level.

Further, the on-bias period 2 is a period when a voltage of a predetermined level is externally applied to the driving transistor in order to reduce or eliminate hysteresis of the driving transistor of a pixel and to reduce the effect thereof.

The compensation and scan period 3 is a period for compensating for the threshold voltage of the driving transistor provided in each pixel 100. In addition, the compensation and scan period 3 is a period for activating pixels to write data by simultaneously transmitting scan signals to each of the plurality of pixels.

The driving may further include an initialization period for initializing a node voltage of the driving circuit in each pixel before the reset period 1 to be the same as in inputting the threshold voltage of the driving transistor. However, the driving is not limited thereto and may not include the initialization period. Further, the driving may further include a light emission-off period for turning off light emission for the purpose of black insertion or dimming after light emission is carried out in each pixel.

The sequences of the reset period 1 and the on-bias period 2 may be shifted relative to each other, i.e., the on bias period 2 may occur before the reset period 1, depending on the embodiment.

The reset period 1, the on-bias period 2, and the compensation and scan period 3 are extinction periods in which pixels are not lighted, while the light emission period 4 is a light emission period in which pixels are lighted. The compensation and scan period 3 may be sequentially carried out for each scan line, but the reset period 1, the on-bias period 2 and the light emission period 4, other than the compensation and scan period 3, may be simultaneously carried out in the entire display unit 10, as shown in FIG. 2.

In the progressive emission scheme of the related art, data are sequentially input for each scan line, and soon after, light emission is sequentially carried out. However, in the driving method of pixels in an exemplary embodiment, data are sequentially input, and batch light emission is wholly carried out after completing data input.

The driving method of pixels may help to reduce or eliminate the effect of IR drop in data writing and maybe useful in displaying three-dimensional stereoscopic images of the shutter glasses type. However, the driving method requires more current to flow in the light emission period in order to keep the same luminance as in the progressive emission scheme. For this purpose, the output of the data IC needs to be extended, and the voltage level difference between the first power source voltage ELVDD and the second power source voltage ELVSS transmitted from the power source controller 60 needs to be increased. Further, as the current for driving light emission increases, the difference between light emitting voltage levels of the first power source voltage ELVDD and the second power source voltage ELVSS resulting from IR drop or IR rise determined by light emission current and wire resistance is also reduced. Therefore, since the voltage difference between the first power source voltage ELVDD and the second power source voltage ELVSS is established and controlled to be great in order to ensure a saturated operation of the driving transistor which is a component of a pixel, power consumption significantly increases as a result. Although the supplied voltage margin is established, considering IR drop, the saturation characteristics of the driving transistor are not perfect to result in lowering optical characteristic uniformity in implementing image quality of the display unit.

Therefore, the pixel, and the display device including the pixel, of the present embodiment enable light emission current to flow through the data lines in the display unit 10 to reduce IR drop of the power supply voltage supplied to the organic light emitting diode for the light emission period 4 particularly for simultaneous light emission in the pixel driving. Accordingly, it is possible to increase optical characteristic uniformity to address non-uniform supply voltage distribution in the display unit.

Figure 3:
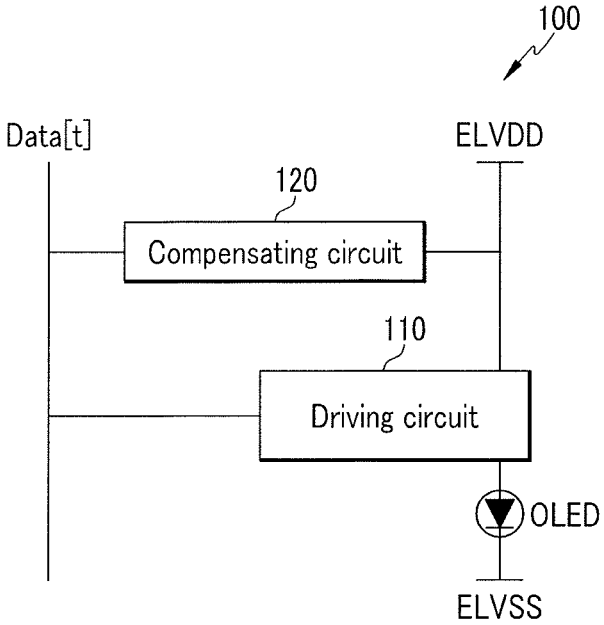
FIG. 3 is a diagram showing a pixel configuration of a display device according to an exemplary embodiment.

FIG. 3 is a diagram showing a configuration of a pixel 100 of a display device proposed to solve problems of the power wire for supplying power source voltage applied to pixels according to an exemplary embodiment.

According to the exemplary embodiment of FIG. 3, the pixel 100 includes an organic light emitting diode (OLED) for emitting light, a driving circuit 110 for transmitting driving current to the organic light emitting diode depending on data voltage, and a compensating circuit 120 for applying a first power source voltage ELVDD supplied to the pixel 100 to the data line DATA for transmitting data signals corresponding to the pixel.

The compensating circuit 120 is connected between the data line DATA and the power wire for transmitting the first power source voltage ELVDD to enable current to flow to the data line DATA for light emission of the organic light emitting diode (OLED) for the light emission period 4 for simultaneous light emission. As a result, IR drop of the power source voltage is reduced as compared to the method of making the display unit emit light only with the power wire for supplying power source voltage in the related art, such that it is easy to ensure screen uniformity and to lower light emitting voltage, thereby providing the effect of reducing power consumption.

Figure 4:
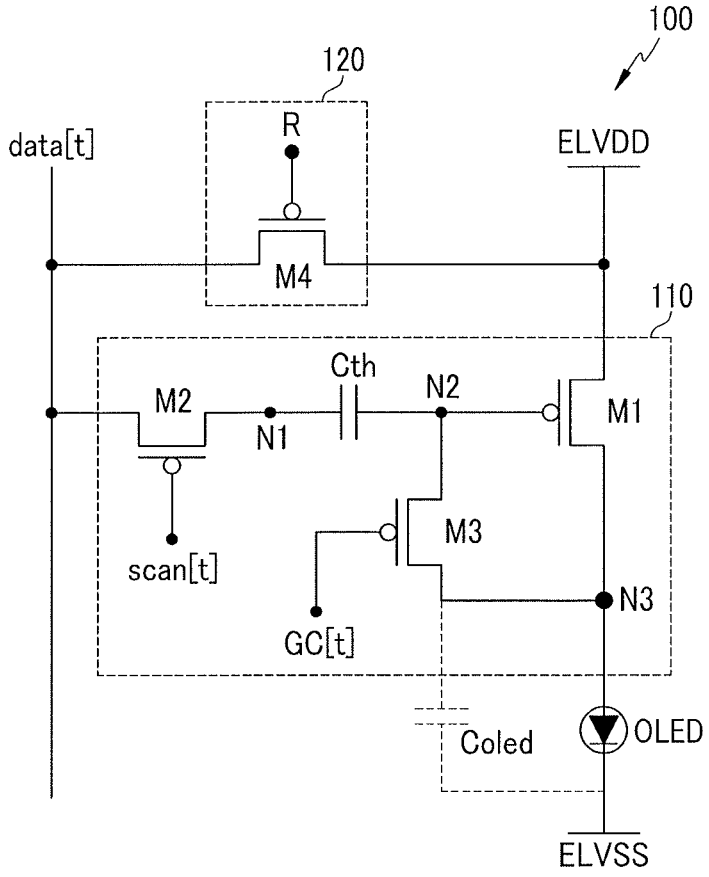
FIG. 4 is a circuit diagram showing a pixel configuration according to the exemplary embodiment of FIG. 3.

A specific circuit diagram of a pixel according to the exemplary embodiment of FIG. 3 is shown in FIG. 4.

Referring to FIG. 4, the driving circuit 110 as a component of the pixel 100 includes three transistors and one capacitor. The compensating circuit 120 as a component of the pixel 100 includes one transistor. However, the structure of a driving circuit is not limited to the exemplary embodiment of FIG. 4, and particularly, the structure of the driving circuit 110 can have combinations of various circuit elements. However, in the circuit structure of the pixel 100 of the present embodiment, the compensating circuit 120 may include at least one transistor that can electrically connect a corresponding data line to a power wire for supplying power source voltage.

The pixel 100 in FIG. 4 includes an organic light emitting diode (OLED), a driving circuit 110 connected to the organic light emitting diode to supply current depending on data signals, and a compensating circuit 120 connected between the data line connected to the driving circuit and the power wire for supplying power source voltage to electrically connect the data line to a power wire.

The anode electrode of the organic light emitting diode (OLED) is connected to the driving circuit 110 and the cathode electrode thereof is connected to the second power source voltage ELVSS. The organic light emitting diode (OLED) as described above generates light at predetermined luminance in response to the current supplied from the driving circuit 110.

However, in an exemplary embodiment, each pixel 100 constituting the display unit 10 receives data signals supplied to the data line D1 to Dm when scan signals are sequentially supplied to the scan line S1 to Sn for a partial period of one frame (aforementioned compensation and scan period 3).

However, for the rest periods of one frame (aforementioned reset period 1, on-bias period 2, and light emission period 4), the scan signals applied to each scan line S1 to Sn, the first power source voltage ELVDD and/or the second power source voltage ELVSS applied to each pixel 100, gate signals applied to each gate line GC1 to GCn, and compensating control signals applied to each compensating wire RL may be simultaneously applied to each pixel 100 at a predetermined voltage level specified, respectively.

Therefore, the driving circuit 110 equipped in each pixel 100 may include three transistors M1 to M3 and one capacitor Cth. In an exemplary embodiment, the coupling effect between the first capacitor Cth and a parasitic capacitor Coled may be used, considering the capacity of the parasitic capacitor Coled generated by the anode electrode and the cathode electrode of the organic light emitting diode.

In FIG. 4, the driving circuit 100 includes a driving transistor M1 connected to the anode electrode of the organic light emitting diode and the voltage line of the first power source voltage ELVDD to transmit current to the organic light emitting diode, a switching transistor M2 connected between the data line and the driving transistor M1 to receive data signals and to transmit data voltage corresponding thereto to the driving transistor M1, and a threshold voltage compensation transistor M3 connected between the gate of the driving transistor M1 and the anode electrode of the organic light emitting diode to compensate for the threshold voltage of the driving transistor M1. Further, the driving circuit 100 includes a first capacitor Cth formed between the driving transistor M1 and the switching transistor M2 to store data voltage depending on data signals and voltage for compensating for the driving transistor M1.

Here, the driving transistor M1 includes a gate connected to a second node N2, a first end connected to the first power source voltage ELVDD power wire, and a second connected to a third node N3 to which the anode electrode of the organic light emitting diode (OLED) is connected.

The switching transistor M2 includes a gate connected to the scan line to which the corresponding scan signals scan[t] are transmitted, a first end connected to the corresponding data line in which the data signals Data[t] are input, and a second end connected to the first node N1.

The threshold voltage compensation transistor M3 includes a gate electrode connected to the gate line to which the corresponding gate signals GC[t] are transmitted, a first end connected to the second node N2 to which the gate of the driving transistor M1 is connected, and a second other end connected to the third node N3 to which the second end of the driving transistor M1 is connected.

The first capacitor Cth includes a first electrode connected to the first node N1 to which the second end of the switching transistor M2 is connected and a second electrode connected to the second node N2 to which the gate of the driving transistor M1 is connected.

Meanwhile, the compensating circuit 120 of FIG. 4 includes a compensating transistor M4 having a gate connected to a compensating control line to which compensating control signals R are transmitted, a first end connected to the power wire to which the first power source voltage ELVDD is supplied, and a second end connected to corresponding data line in which the data signals Data[t] are input.

The circuit configurations of the driving circuit 110 and the compensating circuit 120 of the pixel according to the exemplary embodiment are not limited to the embodiment of FIG. 4, and may be any combination and configuration of circuits so long as functions of a circuit carried out by the circuit element of the pixel 100 of FIG. 4 can be carried out.

In the exemplary embodiment shown in FIG. 4, the transistors M1 to M4 may be implemented as PMOS transistors, but may also be implemented as NMOS transistors.

The operation of the circuits element included in the pixel 100 of FIG. 4 will now be described.

In the compensation and scan period 3, when the corresponding scan signals scan[t] having the gate-on voltage level is input to the gate of the switching transistor M2 to turn on the switching transistor M2, the voltage transmitted from the data line through the switching transistor M2 is applied to the first node N1.

When the voltage of the gate-on voltage level is applied to the gate of the driving transistor M1, the driving transistor M1 is turned on to apply the voltage corresponding to the first power source voltage ELVDD and the threshold voltage of the driving transistor M1 to the second node N2.

In the first capacitor Cth, the voltage as much as the difference between the voltage applied to the first node N1 and the voltage applied to the second node N2 corresponding to the first power source voltage ELVDD and the threshold voltage of the driving transistor M1 is stored.

Pixels are activated for the compensation and scan period 3 to write data depending on the data signals and simultaneously to compensate for the threshold voltage of the driving transistor.

For the light emission period 4 after finishing data storage and compensation in this way, the switching transistor M2 is turned on by the scan signal scan[t] input to the gate of the switching transistor M2, while the compensating controls signal R input to the gate of the compensating transistor M4 are also transmitted at the corresponding gate-on voltage level to turn on the compensating transistor M4. Then, the voltage level of the voltage applied to the first node N1 changes to correspond to the voltage value of the first power source voltage ELVDD supplied via the data line through the compensating transistor M4.

The voltage of the second node N2 also changes due to the coupling effect of the first capacitor Cth. The organic light emitting diode emits light by making the voltage difference between the first power source voltage ELVDD and the second power source voltage ELVSS great for the light emission period 4. In this case, the current flowing into the organic light emitting diode is uniform current, independent of the threshold voltage of the driving transistor M1.

In the pixel 100 according to the exemplary embodiment, since the compensating transistor M4 is switched to be turned on to electrically supply the first power source voltage ELVDD to the corresponding data line for the simultaneous emission period 4, the current flowing through the voltage wire of the first power source voltage ELVDD also flows through the data line (RGB data line) which occupies a significant area in the display unit. Accordingly, IR drop due to the voltage wire can be reduced. As a result, it is possible to improve deteriorated optical characteristic uniformity due to non-uniform distribution of the first power source voltage ELVDD in the display unit. In addition, since the voltage transmitted to the second node N2 interworks with the first power source voltage ELVDD of each pixel for the light emission period 4, it is possible to eliminate voltage changes between the gate and the source of the driving transistor M1 due to IR drop, thereby implementing more uniform luminance even in driving large-area display devices.

Particularly, in the pixel structure in which a small number of circuit components are simply combined as shown in FIG. 4, as capacitors occupy a large area, use of only one capacitor may result in a reduced circuit area, and the aperture ratio is thus advantageously ensured. Accordingly, it is possible to implement exact luminance and improve a display panel life-span of display devices.

The process and the detailed operation of driving the display device including the pixel 100 shown in FIG. 4 will be described in more detail with reference to the driving timing diagram of FIG. 5.

Figure 5:
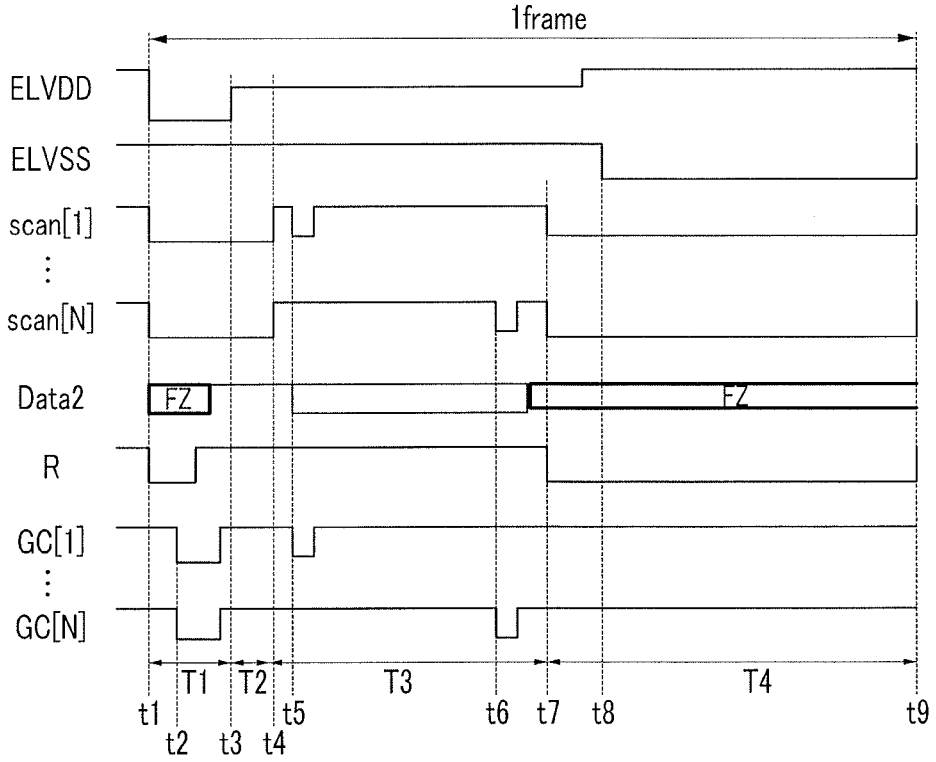
FIG. 5 is a driving timing diagram of a pixel according to the exemplary embodiment of FIG. 4.

Referring to the timing diagram of FIG. 5, the one frame in which the pixel is driven is constituted by a reset period T1, an on-bias period T2, a compensation and scan period T3, and a light emission period T4.

At time t1 of the reset period T1, all of the scan signals scan[1] to scan[N] transmitted to the switching transistor M2 of the pixel 100 are transmitted at a low level which is the gate-on voltage level. Further, in this case, the compensating control signals R transmitted to the compensating transistor M4 are also transmitted at a low level.

Then, the first power source voltage ELVDD is transmitted to the first node N1 through the compensating transistor M4 and the switching transistor M2 switched turned-on at the time t1. The first power source voltage ELVDD is transmitted through the corresponding data line from the power wire supplying the first power source voltage ELVDD. In this case, the transmitted first power source voltage ELVDD may be a voltage of a low level. For example, 0V may be applied.

In this case, the data line may be in the floating condition in which current is externally not supplied. That is, it is possible to establish the floating condition so that current is not supplied to the data IC itself, or to add and connect a switch between the data IC and the data line, and to implement the floating condition through on/off control of the switch.

The low level voltage applied to the first node N1 makes the driving transistor M1 turned on, and the first power source voltage ELVDD is transmitted to the anode electrode of the organic light emitting diode, that is, the third node N3, through the driving transistor. That is, in the above example, the first power source voltage ELVDD of 0V is transmitted.

At time t2, all of the gate signals GC[1] to GC[N] are transmitted at a low level of the gate-on voltage level through the gate line connected to the gate of the threshold voltage compensation transistor M3 of each pixel 100. The threshold voltage compensation transistor M3 is turned on to electrically connect the gate and the other end (drain) of the driving transistor M1, and to operate the driving transistor M1 as a diode.

Therefore, the voltage across the gate of the driving transistor M1, i.e., the voltage applied to the second node N2, is lowered due to the coupling effect of the first capacitor Cth and the parasitic capacitor Coled of the organic light emitting diode, as compared to the capacity ratio. That is, the gate electrode voltage of the driving transistor M1 becomes low enough to be 0V which is a voltage value of the first power source voltage ELVDD in the above example. Therefore, the data voltage of the previous frame stored in the gate electrode voltage of the driving transistor M1 is reset.

Next, the scan signals scan[1] to scan[N] are still transmitted at a low level in the on-bias period T2. In this period, the compensating control signals R are transmitted at a high level. As a result, the compensating transistor M4 is turned off, so that the first power source voltage ELVDD may be blocked not to be transmitted to the data line, and then the voltage transmitted through the data line is applied at a high level. For example, voltage at a level high enough, approximately 12V is applied. The voltage applied to the first node N1 is then set to a high level of 12V.

The voltage across the second node N2 which is a gate node of the driving transistor M1 was set to a low level (e.g., 0V) in the previous reset period T1, and the driving transistor M1 is still turned on. At time t3, the first power source voltage ELVDD is raised to a higher level than in the previous reset period T1 and transmitted. Therefore, in the on-bias period T2, the voltage applied to the second node N2 may be at a low level, the anode electrode voltage (the third node N3 voltage) of the organic light emitting diode (OLED) may be at a predetermined high level determined by raising the first power source voltage ELVDD. For example, the first power source voltage ELVDD may be raised to approximately 8V at time t3.

Next, in the compensation and scan period T3, the scan signals scan[1] to scan[N] start to be sequentially transmitted at a low level at time t5 and transmission thereof finishes at time t6. The gate signals GC[1] to GC[N] are also sequentially transmitted at time t5 to time t6 at a low level. In this case, the compensating control signals R still keep a high level, which is the gate off level, and the first power source voltage ELVDD keeps a predetermined high level of approximately 8V as in the above example.

In all of the pixels in the display unit, each of the switching transistors M2 is turned on depending on the scan signals scan[1] to scan[N], and the voltage depending on the corresponding data signals is transmitted to the first node N1. In addition, the threshold voltage compensation transistor M3 is turned on to diode-connect the driving transistor M1.

Data voltage Vdata depending on the data signal Data[t] is then applied to the first node N1 voltage. The voltage value which is the sum of the voltage applied to the third node N3 and the threshold voltage Vth of the driving transistor M1 is applied to the second node N2 which is the gate node of the driving transistor M1 because of the diode-connection. In the above example, since the anode electrode voltage (the third node N3 voltage) of the organic light emitting diode (OLED) was raised to approximately 8V because of the first power source voltage ELVDD, the voltage applied to the second node N2 will be 8+Vth(V).

The first capacitor Cth connected between the first node N1 and the second node N2 stores voltage as much as the difference in voltage applied across the first node and the second node. That is, in the above example, 8+Vth−Vdata(V) will be stored.

For the reset period T1, the on-bias period T2, and the compensation and scan period T3, since the second power source voltage is kept at a predetermined high level (i.e., 12V as an example), light emission does not occur in the organic light emitting diode.

Meanwhile, at time t7 in the light emission period T4, when all of scan signals scan[1] to scan[N] are transmitted at a low level again and the compensating control signals R are transmitted at a low level again, the switching transistor M2 and the compensating transistor M4 of all pixels in the display unit are simultaneously turned on. Then, the first power source voltage ELVDD which is kept at 8V by means of the switching transistor M2 and the compensating transistor M4 is applied to the first node N1. In this case, the second node N2 voltage is raised by 8V because of the coupling effect of the first capacitor Cth. Therefore, in the above example, the second node N2 voltage is raised to 16+Vth−Vdata(V). In this case, the voltage Vgs between the gate and the source of the driving transistor M1 becomes (16+Vth−Vdata)-8(V), that is, 8+Vth−Vdata(V).

Thereafter, at time t8, the first power source voltage ELVDD is applied at a high level further raised, and the second power source voltage ELVSS is applied as a low level voltage. For example, the first power source voltage ELVDD of 12V and the second power source voltage ELVSS of 0V may be applied. For the period of time t8 to time t9, the organic light emitting diode emits light because of a voltage difference between the first power source voltage ELVDD and the second power source voltage ELVSS. For the light emission period at time t8 to time t9, since the first power source voltage ELVDD rises from 8V to 12V and the first node N1 is connected to the second node N2 by means of the compensating transistor M4, the switching transistor M2, and the driving transistor M1, the voltage Vgs between the gate and the source of the driving transistor M1 is still kept the same. That is, 8+Vth−Vdata (V) is maintained.

Therefore, the driving current flowing through the anode electrode of the organic light emitting diode (OLED) for the light emission period is calculated with the voltage values established in the above example as follows.

$$I=k(Vgs-Vth)^2=k(8+Vth-V\text{data}-Vth)^2=k(8-\text{data})^2 \quad \text{(Equation 1)}$$

Where k=0.5u(W/L)Cox.

That is, the current depending on uniform data signals, independent of the threshold voltage Vth of the driving transistor M1, flows into the organic light emitting diode (OLED) as in Equation 1.

In each period of the driving timing, the voltage of the first power source voltage ELVDD and the second power source voltage ELVSS may be variously established depending on panel characteristics and preferred settings as described with reference to FIG. 1.

Figure 6:
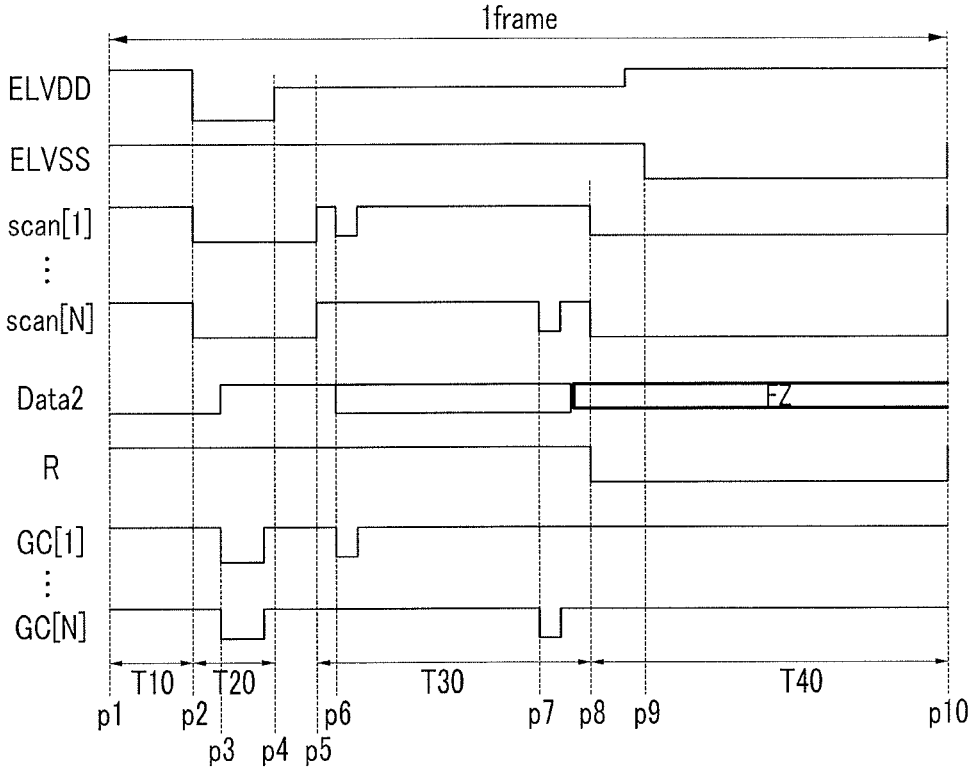
FIG. 6 is a driving timing diagram of a pixel according to another exemplary embodiment of FIG. 4.

Another operation of the pixel 100 of FIG. 4 may be implemented according to the driving timing diagram illustrated in FIG. 6. Referring to the timing diagram of FIG. 6, the one frame in which the pixel is driven is constituted by an on-bias period T10, a reset period T20, a compensation and scan period T30, and a light emission period T40, with respective time period being indicated as p1 to p10.

The driving method of FIG. 6 is not much different from FIG. 5, but the sequences of the on-bias period T10 and the reset period T20 are shifted to each other in driving pixels. That is, the on-bias period T10 precedes the reset period T20. Further, one characteristic is that the voltage level of the first power source voltage ELVDD applied in the on-bias period T10 is established higher than in the on-bias period T2 of FIG. 5. For example, if the voltage value of the first power source voltage ELVDD in the on-bias period T2 of FIG. 5 was established to be 8V, the voltage value may be established to be higher, 12V, in the on-bias period T10 of FIG. 6.

As a result, the on-bias operation is implemented more positively.

In the reset period T20 of FIG. 6, unlike FIG. 5, the scan signals scan[1] to scan[N] are transmitted to all of the pixels to turn on the switching transistor M2, but the compensating control signals R applied to the compensating transistor M4 are transmitted at a high level to turn off the compensating transistor M4 of all of the pixels. Therefore, the power wire of the first power source voltage ELVDD is electrically disconnected from the data line, and the voltage applied to the first node N1 is an output voltage of a low level externally applied through the data line. For example, the voltage of 0V may be applied through the data line. Similarly in this period, all of the gate signals GC[1] to GC[N] are simultaneously transmitted at a low level to turn on the compensation transistor M3 to diode-connect the driving transistor M1. The voltage applied to the second node N2 is thus lowered to a low level to reset the data voltage stored in the previous frame.

Referring to FIG. 6, since the operations after resetting the data voltage are the same as those of FIG. 5, the current depending on uniform data signals, independent of the threshold voltage Vth of the driving transistor M1, flows into the organic light emitting diode (OLED) to display images.

Figure 7:
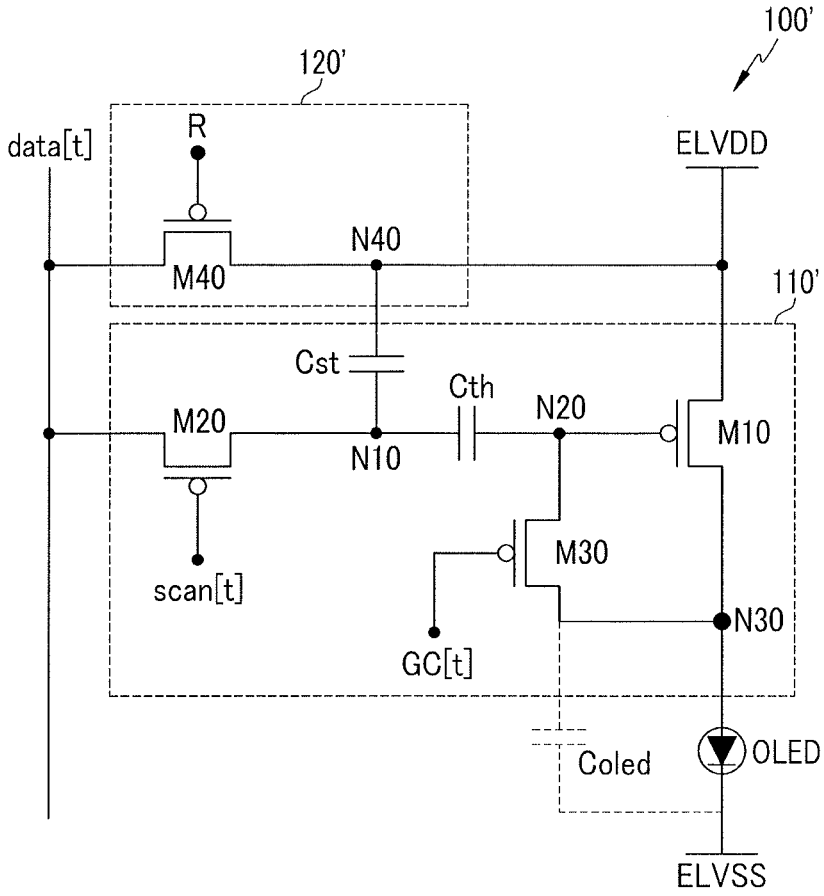
FIG. 7 is a circuit diagram showing a pixel configuration according to another exemplary embodiment of FIG. 3.

FIG. 7 shows a driving circuit diagram including a driving circuit 110' include three transistors M10, M20, M30 and two capacitors Cth, Cst, which is another exemplary embodiment different from the simplest structure of the driving circuit 110 proposed in FIG. 4. As shown in FIG. 7, the driving circuit 110' includes a second capacitor Cst having a first electrode connected at a node N10 between the first capacitor Cth and the switching transistor M20, and a second electrode connected to a node N40 between a compensating transistor M40 and the power source voltage ELVDD.

Since functions depending on the configuration of the circuit element and the process of driving the display device of FIG. 7 are not different from those of the pixel of FIG. 4, detailed description will be omitted.

Figure 8:
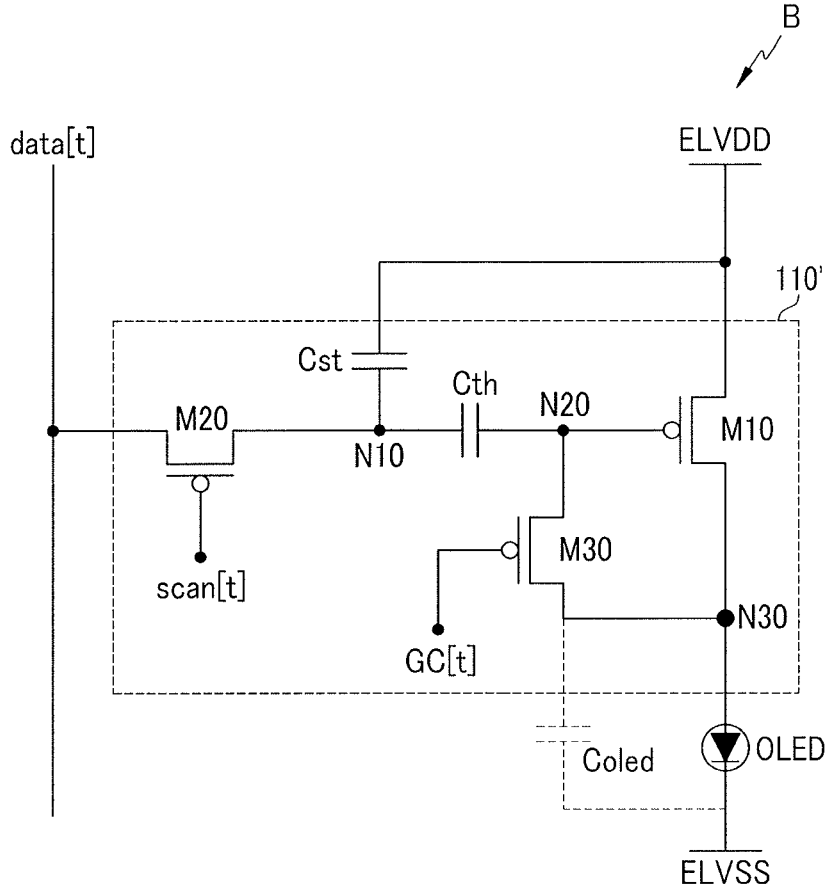
FIG. 8 is a diagram showing a pixel unit configuration of a display unit in a display device according to an exemplary embodiment.

FIG. 8 is a diagram showing another example of a unit pixel according to an exemplary embodiment. The unit pixel B shown in FIG. 8 does not include the compensating circuits 120 and 120' in the pixel structure shown in FIG. 4 and FIG. 7. Instead, the second capacitor Cst in the driving circuit 110' of FIG. 8 has the second electrode connected between the power source voltage ELVDD and the driving transistor M10.

The display unit 10 according to an exemplary embodiment may be constituted by disposing a plurality of unit pixels of at least one type between the unit pixel A and the unit pixel B. The unit pixel A is implemented in the pixel structure including the pixel structure shown in FIG. 4 and FIG. 7, i.e., the pixel structure including the compensating circuits 120 and 120'.

According to the exemplary embodiment, since a voltage difference of the power source voltage ELVDD due to IR drop does not occur sharply for every pixel, but continuously occurs over the entire display unit, it is possible to compensate the power wire although the compensating circuit is not provided for every pixel, but is provided for some pixels.

Hereinafter, FIG. 9 to FIG. 14 show the pixel configuration of the display unit 10 in a display device, disposed with the unit pixels A and B in a variety of ways. For better understanding and ease of description, the display unit is shown to be divided into a 6×6 matrix, but embodiments are not limited thereto.

FIG. 9 shows a configuration that the entire display unit 10 is constituted by only the unit pixels A. If the driving circuit 110 of the unit pixel A is constituted by three transistors and one capacitor as in the exemplary embodiment of FIG. 4, the area occupied by the pixels is reduced. Therefore, the configuration shown in FIG. 9 enables a configuration of a display unit in which the aperture ratio is further ensured while reducing power wire resistance.

FIG. 10 to FIG. 12 show a structure in which a plurality of unit pixels A or a plurality of unit pixels B are disposed along rows, i.e., in a horizontal direction. In FIG. 10 to FIG. 12, the same unit pixels A or B are disposed in rows, but the embodiments are not limited thereto. For example, the same unit pixels A or B may be disposed in columns, e.g., in a vertical direction.

FIG. 10 shows a structure in which a first row has a plurality of unit pixels A and a second row having a plurality of unit pixels B are alternately disposed in the vertical direction.

FIG. 11 shows a structure in which two second rows of unit pixels B per each first row of unit pixels A are alternately disposed in the vertical direction. FIG. 12 shows a structure in which the three second rows of unit pixels B per each first row of unit pixels A are alternately disposed are disposed in the vertical direction.

As the number of the second horizontal lines disposed to correspond to one first horizontal line increases, the number of compensating transistors constituting the compensating circuit of a pixel is reduced. Therefore, the average number of transistors constituting a driving circuit is reduced. It is possible to regulate compensation of the power wire and the area occupied by the pixels by appropriately adjusting the number and the layout of unit pixels A and unit pixels B depending on the display unit area and the metal process for the transistors in the process of manufacturing display devices.

The configuration of a display unit in which horizontal lines constituted for each unit pixels are alternately disposed is not limited to those configuration shown FIG. 10 to FIG. 12.

FIG. 13 is a schematic diagram showing the display unit in which a plurality of unit pixels A and a plurality of unit pixels B are disposed along the 1×1 dot (DOT) layout. That is, FIG. 13 shows a structure in which the plurality of unit pixels A and the plurality of unit pixels B are alternately disposed in both the horizontal direction and the vertical direction. Even in this structure, there is no limit with respect to the ratio of the number of unit pixels A and unit pixels B, and the sequence of disposition may be diversified.

FIG. 14 shows the structure in which two unit pixels B per unit pixel A are consecutively disposed in the horizontal direction and the vertical direction. FIG. 14 is a transformation of the dot structure of FIG. 13, in which there is no limit with respect to the number of unit pixels B per unit pixel A consecutively disposed. That is, the driving circuit of the display unit may be disposed considering the ease of power wire layout, the convenience of processes, the display unit area, etc.

By way of summation and review, in accordance with embodiments, a driving circuit compensates for power wires of the organic light emitting diode, a display device including the driving circuit in order to ensure uniformity of a display screen, and to lower the light emitting voltage as compared to driving methods of light emission in the related art. Further, in accordance with embodiments, a pixel may have advantages of ensuring the aperture ratio of pixels even with a simplified circuit structure and small area as compared to driving circuits in the related art, a display device including the pixel, and a method of driving the display device.

Additionally, in accordance with embodiments, a pixel may include a circuit structure which compensates the power wire in order to improve non-uniform luminance for each panel position resulting from a voltage drop in the power wire for supplying consumed power to the organic light emitting diode of pixels in the display device. Further, the display device according to embodiments, a driving circuit for compensating the power wire is provided to reduce the volume of voltage drop, such that an established driving voltage margin of an organic light emitting diode may be reduced, thereby providing a display device which reduces overall power consumption. Moreover, the quality of optical characteristics may be improved on a display device screen and a long life span of a display panel may be ensured by improving the aperture ratio of pixels by using a simplified circuit structure and an efficient circuit layout.

The drawings and the detailed description described above are examples for the present invention and provided to explain embodiments and the scope of the present invention described in the claims is not limited thereto. Therefore, it will be appreciated to those skilled in the art that various modifications are made and other equivalent embodiments are available. Those skilled in the art can omit some of the constituent elements described in the present specification without deterioration in performance thereof or can add constituent elements to improve performance thereof. Further, those skilled in the art can modify the sequence of the steps of the method described in the present specification depending on the process environment or equipment. Therefore, the range of the present invention must be determined by the scope of the claims and the equivalent, not by the described exemplary embodiments.

What is claimed is:

1. A pixel, comprising:

an organic light emitting diode;

a driving circuit for generating and transmitting a driving current depending on data signals to the organic light emitting diode; and at least one switch connected between a power wire for applying a first voltage to the organic light emitting diode and a data line for transmitting the data signals, the at least one switch including a compensating circuit for electronically connecting the power wire and the data line for a predetermined period to transmit the first voltage through the data line.

2. The pixel of claim 1, wherein:

the predetermined period is a period of light emission when the organic light emitting diode is lighted.

3. The pixel of claim 1, wherein:

the on/off of the switch is controlled depending on switching control signals.

4. The pixel of claim 1, wherein:

the organic light emitting diode includes a first electrode connected to the driving circuit and a second electrode connected to a power supply for applying a second voltage, and the voltage difference between the first voltage and the second voltage is kept above a predetermined voltage to light the organic light emitting diode for the predetermined period.

5. The pixel of claim 1, wherein the switch:

electronically connects the power wire and the data line for periods other than the predetermined period; and transmits the first voltage to reset the operation of the driving circuit.

6. The pixel of claim 5, wherein the first voltage is a low voltage below a predetermined level.

7. The pixel of claim 1, wherein the switch is a PMOS transistor or an NMOS transistor.

8. The pixel of claim 1, wherein the driving circuit comprises:

a first transistor including a gate connected to a scan line for transmitting scan signals, a first end connected to the data line, and a second end connected to a first node;

a second transistor including a gate connected to a second node, a first end connected to the power wire, and a second end connected to the first electrode of the organic light emitting diode;

a third transistor including a gate connected to a gate line for transmitting gate signals, a first end connected to the second node, a second end connected to both the second end of the second transistor and the first electrode of the organic light emitting diode; and a first capacitor including a first electrode connected to the first node and the other electrode connected to the second node.

9. The pixel of claim 8, wherein the first to third transistors are a PMOS transistor or an NMOS transistor.

10. The pixel of claim 8, further comprising:

a second capacitor including a first electrode connected to the first node and a second electrode connected to the power wire.

11. The pixel of claim 1, wherein:

the driving circuit is activated before the predetermined period to write data voltage depending on the data signals, and to compensate for the threshold voltage of a driving transistor for generating driving current depending on the data signals.

12. The pixel of claim 1, wherein:

the organic light emitting diode includes a first electrode connected to the driving circuit and a second electrode connected to a power supply for applying a second voltage, the first voltage is applied as a voltage value of at least three different levels for the one frame period, and the second voltage is applied as a voltage value of at least two different levels for the one frame period.

13. The pixel of claim 12, wherein:

the organic light emitting diode is lighted in the period in which the difference between the first voltage and the second voltage is the greatest.

* * * * *